US009439529B1

(12) United States Patent
Libertowski et al.

(10) Patent No.: US 9,439,529 B1
(45) Date of Patent: Sep. 13, 2016

(54) SCREEN ENCLOSURE CLAMP SYSTEM

(76) Inventors: Donald A. Libertowski, Medina, OH (US); John W. Wills, Odessa, FL (US)

( * ) Notice: Subject to any disclaimer, the term of this patent is extended or adjusted under 35 U.S.C. 154(b) by 0 days.

(21) Appl. No.: 13/542,238

(22) Filed: Jul. 5, 2012

Related U.S. Application Data

(60) Provisional application No. 61/554,954, filed on Nov. 2, 2011.

(51) Int. Cl.
*A47F 5/00* (2006.01)
*A47H 99/00* (2009.01)

(52) U.S. Cl.
CPC ..... *A47H 99/00* (2013.01)

(58) Field of Classification Search
USPC ..... 248/339, 225.21, 229.1, 226.11, 304, 248/305, 306, 308
See application file for complete search history.

(56) References Cited

U.S. PATENT DOCUMENTS 5,687,936 A * 11/1997 Wilson ..... 248/48.2
5,695,163 A * 12/1997 Tayar ..... 248/243
6,651,937 B1 * 11/2003 Wilson ..... 248/48.1
D600,100 S * 9/2009 Moncade ..... D8/367
7,966,703 B2 * 6/2011 Ubinana ..... 24/514
8,919,712 B2 * 12/2014 Chen ..... 248/205.8
2006/0071136 A1 * 4/2006 Livingstone et al. ..... 248/308
2006/0071137 A1 * 4/2006 Livingstone ..... 248/308

* cited by examiner

*Primary Examiner* — Steven Marsh

(57) ABSTRACT

A bracket assembly is removably coupleable to a vertical frame member. The assembly includes a central component having interior and exterior sections. The interior section has an inside edge positioned in contact with the frame member. The interior section has first and second apertures. The exterior section has a leg formed as an extension of the interior section. The interior and exterior sections have planar first and second surfaces. The bracket assembly includes first and second side components. Each side component has a middle leg facing the frame member. Each side component has an inner leg in contact with the frame for coupling the assembly to the frame. Each side component has an outer leg in facing contact with the interior section. A coupling assembly includes apertures through the outer leg and fasteners through the apertures. In this manner the side components are coupled to the central components.

1 Claim, 5 Drawing Sheets

FIG. 3
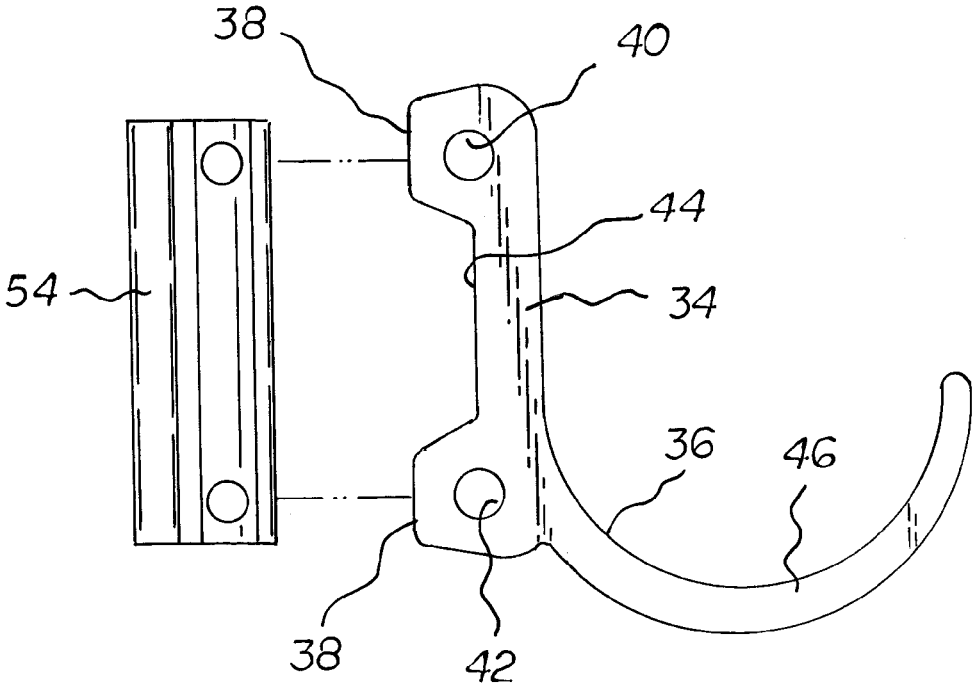
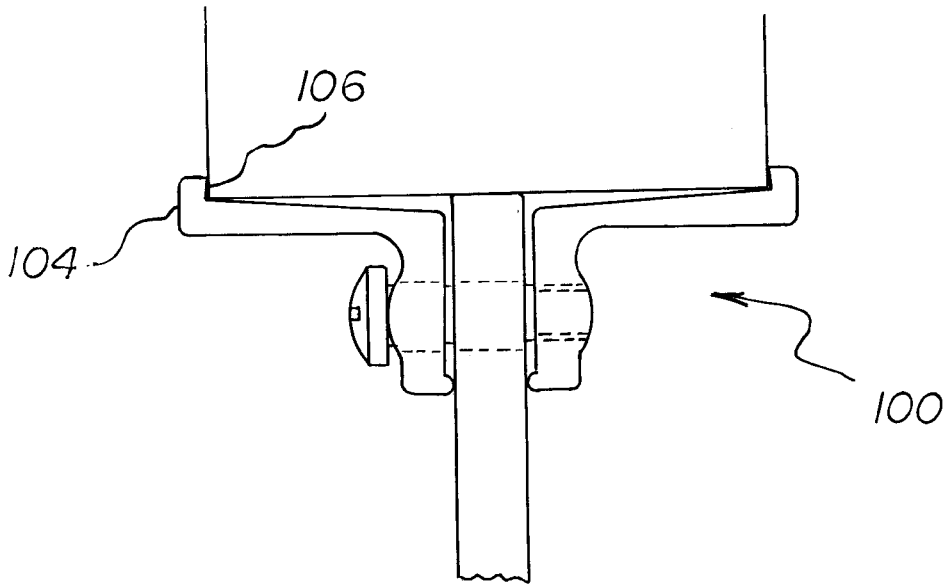
FIG. 4

FIG. 5
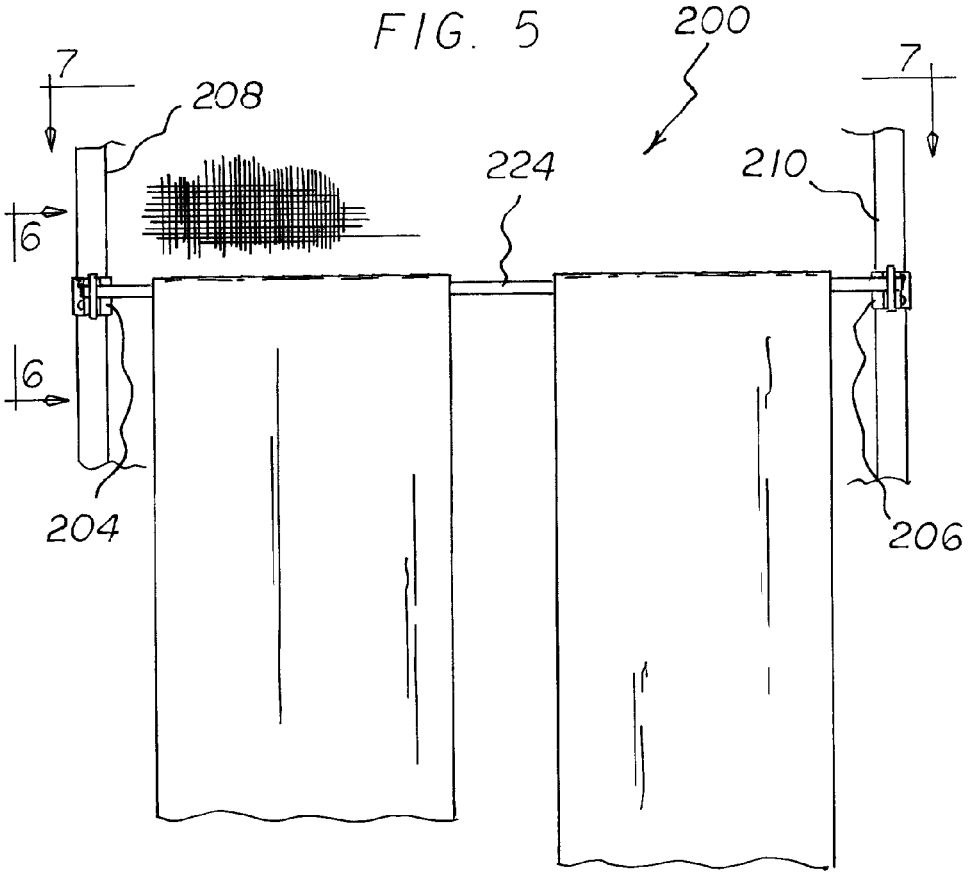
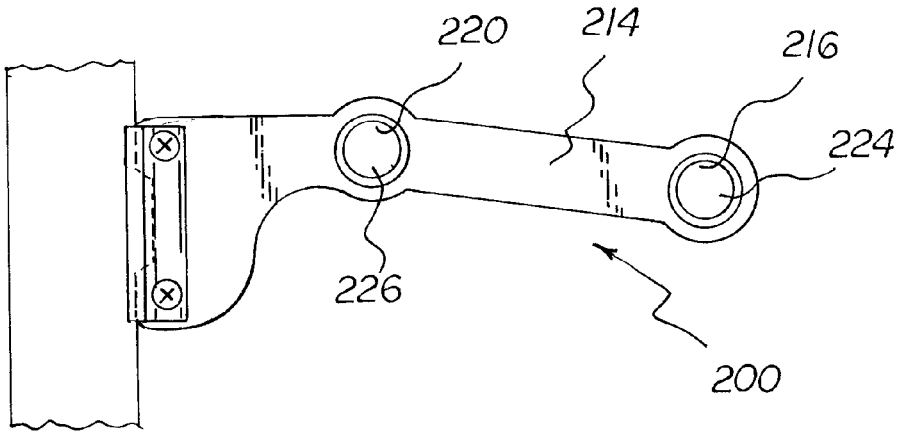
FIG. 6

FIG. 7
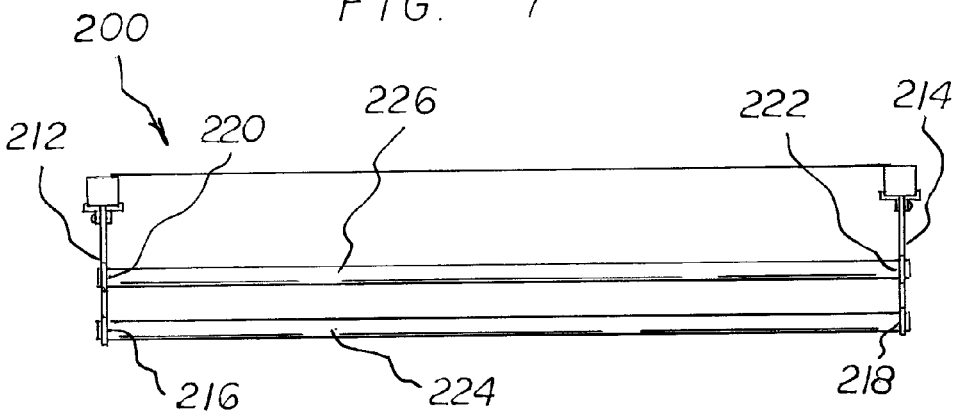
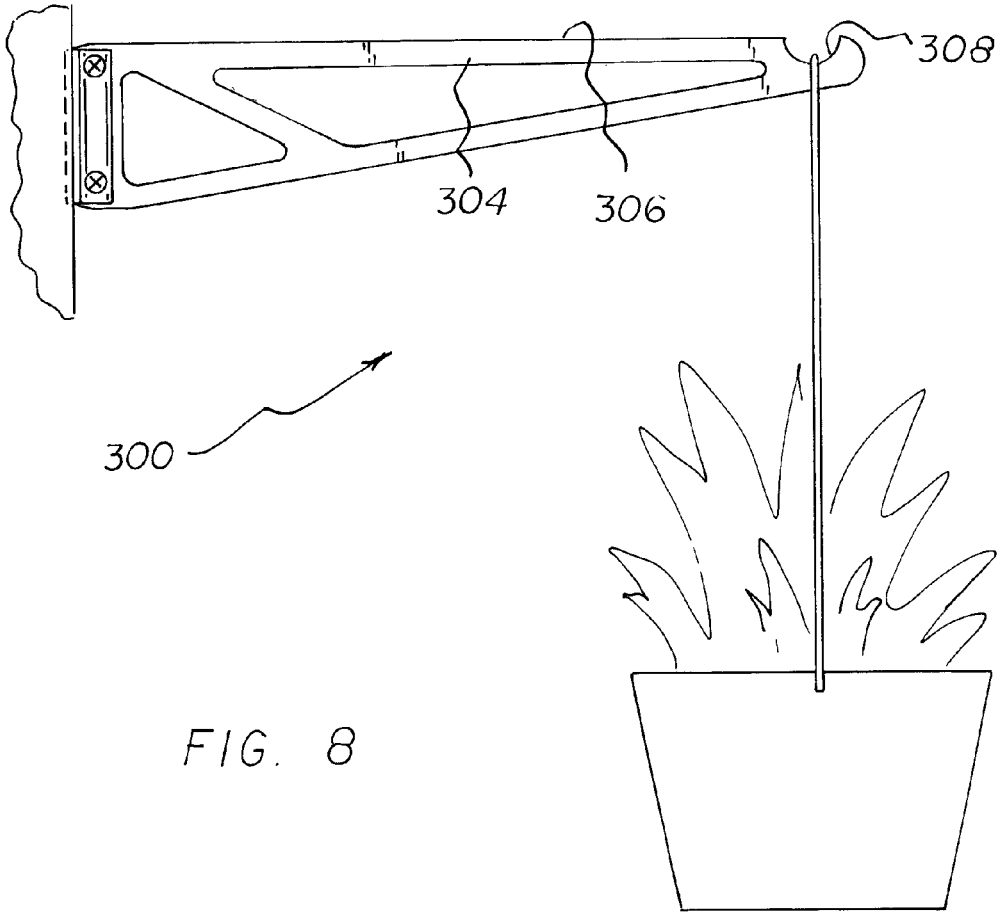
FIG. 8

SCREEN ENCLOSURE CLAMP SYSTEM

RELATED APPLICATION

The present non-provisional patent application is based upon U.S. Provisional Application No. 61/554,954 filed Nov. 2, 2011, the subject matter of which application is incorporated herein by reference.

BACKGROUND OF THE INVENTION

Field of the Invention

The present invention relates to a screen enclosure clamp system and more particularly pertains to removably receiving and supporting swimming-related, swimming pool-related, decorative and screen structural support-related objects at convenient locations within screened enclosures, the receiving and supporting being done in a safe, eye-appealing, convenient and economical manner.

SUMMARY OF THE INVENTION

In view of the disadvantages inherent in the known types of pool enclosure systems of known designs and configurations now present in the prior art, the present invention provides an improved screen enclosure clamp system. As such, the general purpose of the present invention, which will be described subsequently in greater detail, is to provide a new and improved screen enclosure clamp system and method which has all the advantages of the prior art and none of the disadvantages.

To attain this, the present invention essentially comprises a screen enclosure clamp system. A bracket assembly is removably coupleable to a vertical frame member. The assembly includes a central component having interior and exterior sections. The interior section has an inside edge positioned in contact with the frame member. The interior section has first and second apertures. The exterior section has a leg formed as an extension of the interior section. The interior and exterior sections have planar first and second surfaces. The bracket assembly includes first and second side components. Each side component has a middle leg facing the frame member. Each side component has an inner leg in contact with the frame for coupling the assembly to the frame. Each side component has an outer leg in facing contact with the interior section. A coupling assembly includes apertures through the outer leg and fasteners through the apertures. In this manner the side components are coupled to the central components.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved screen enclosure clamp system which has all of the advantages of the prior art pool enclosure systems of known designs and configurations and none of the disadvantages.

It is another object of the present invention to provide a new and improved screen enclosure clamp system which may be easily and efficiently manufactured and marketed.

It is further object of the present invention to provide a new and improved screen enclosure clamp system which is of durable and reliable constructions.

An even further object of the present invention is to provide a new and improved screen enclosure clamp system which is susceptible of a low cost of manufacture with regard to both materials and labor, and which accordingly is then susceptible of low prices of sale to the consuming public, thereby making such screen enclosure clamp system economically available to the buying public.

Even still another object of the present invention is to provide a screen enclosure clamp system for removably receiving and supporting swimming-related, swimming pool-related, decorative and screen structural support-related objects at convenient locations within screened enclosures, the receiving and supporting being done in a safe, eye-appealing, convenient and economical manner.

Lastly, it is an object of the present invention to provide a new and improved clamp system. A bracket assembly is removably coupleable to a vertical frame member. The assembly includes a central component having interior and exterior sections. The interior section has an inside edge positioned in contact with the frame member. The interior section has first and second apertures. The exterior section has a leg formed as an extension of the interior section. The interior and exterior sections have planar first and second surfaces. The bracket assembly includes first and second side components. Each side component has a middle leg facing the frame member. Each side component has an inner leg in contact with the frame for coupling the assembly to the frame. Each side component has an outer leg in facing contact with the interior section. A coupling assembly includes apertures through the outer leg and fasteners through the apertures. In this manner the side components are coupled to the central components.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 2 and 3 are plan and side elevational views taken along lines 2-2 and 3-3 of FIG. 1, respectively, FIG. 3 being exploded.

FIG. 4 is an enlarged plan view similar to FIG. 2 but coupled to an alternate enclosure component.

FIG. 5 is a front elevational view of an alternate embodiment of the invention.

FIGS. 6 and 7 are plan and side elevational views taken along lines 6-6 and 7-7 of FIG. 5.

FIG. 8 is a side elevational view of another alternate embodiment of the invention.

The same reference numerals refer to the same parts throughout the various Figures.

DESCRIPTION OF THE PREFERRED EMBODIMENT

Figure 1:
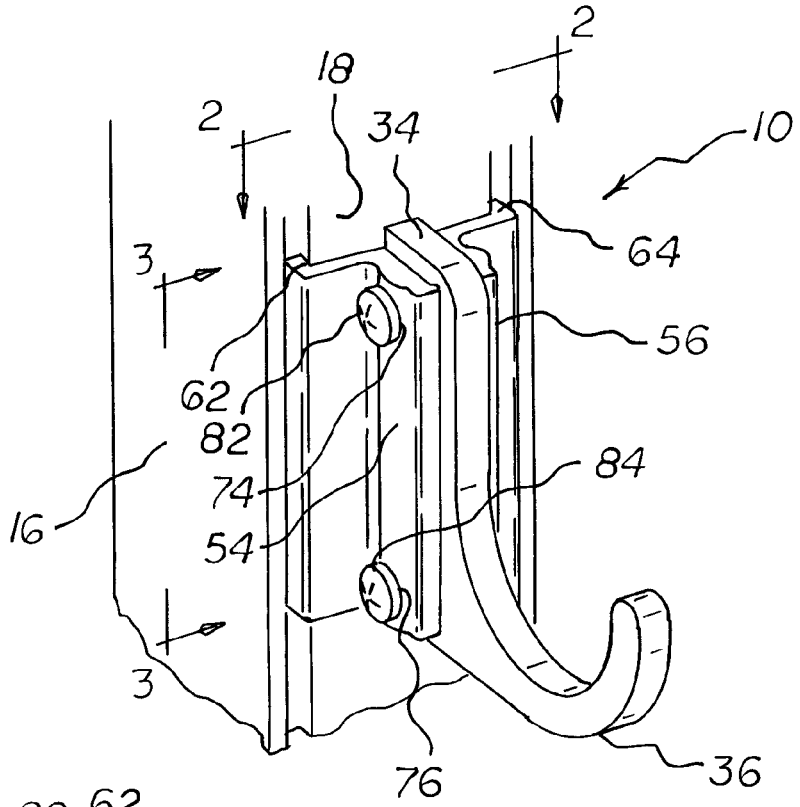
FIG. 1 is a perspective illustration of a screen enclosure clamp system constructed in accordance with the principles of the present invention.
Figure 2:
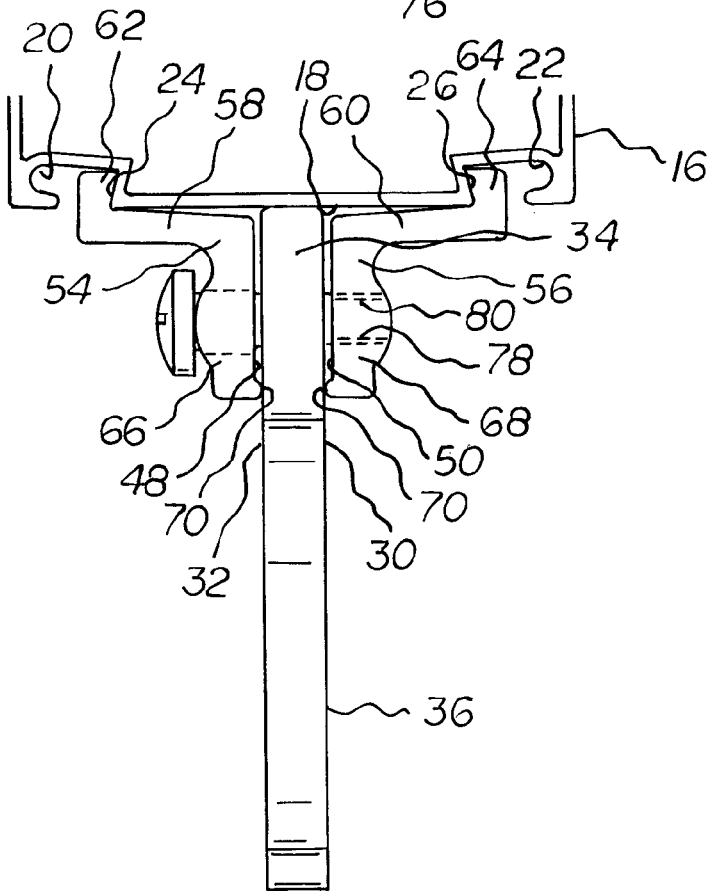

With reference now to the drawings, and in particular to FIG. 1 thereof, the preferred embodiment of the new and improved screen enclosure clamp system embodying the principles and concepts of the present invention and generally designated by the reference numeral 10 will be described.

The present invention, the screen enclosure clamp system 10, is particularly adapted for use, but not exclusive use, in swimming pool enclosures. The system is comprised of a plurality of components. Such components in their broadest context include a bracket assembly and a coupling assembly. Such components are individually configured and correlated with respect to each other so as to attain the desired objective.

First provided is a vertically extending frame member 16. The frame member constitutes a portion of an enclosure. The frame member has a vertically extending front face 18. The frame member has laterally spaced vertical left and right recesses 20, 22. The recesses are provided on opposite sides of the front face. The recesses are configured to include opposed left and right side faces 24, 26. Each side face forms a first acute angle. The first acute angle is greater than 85 degrees with respect to the front face. The frame member forms a vertical central plane. The central plane is provided perpendicular to the front face. The central plane is equally spaced from the side faces.

A bracket assembly 30 is provided. The bracket assembly is removably coupled to the frame member. The bracket assembly includes a central component 32. The central component has an interior section 34. The central component has an exterior section 36. The interior section has an inside edge 38. The inside edge of the interior section is positioned in contact with the front face of the frame member. The interior section has upper and lower apertures 40, 42. The apertures have vertically aligned axes. The inside edge of the interior section has a recessed edge 44. The recessed edge is provided between the apertures. The recessed edge is aligned with the axes. The exterior section has a U-shaped leg 46. The U-shaped leg is integrally formed as an extension of the interior section. The U-shaped leg is laterally spaced from the lower aperture. The U-shaped leg has a midpoint. The midpoint is provided at an elevation beneath the lower aperture. The interior and exterior sections are vertically oriented. The interior and exterior sections contain the central plane. The interior section has a planar left surface 48. The interior section also has a planar right surface 50.

The bracket assembly also includes a left component 54. The bracket assembly includes a similarly configured right component 56. The left component has a middle leg 58. The middle leg faces the front face of the frame member. The middle leg is provided between the left surface of the interior section and the left side face of the recess. The right component has a middle leg 60. The middle leg faces the front face of the frame member. The middle leg is provided between the right surface of the interior section and the right side face of the recess. The left and right components have inner legs 62, 64. The inner legs are provided in facing contact with the left and right side faces of the recess respectively. The inner legs form a second acute angle with respect to the middle leg. The second acute angle is equal to the first acute angle. The left and right components have outer legs 66, 68. The outer legs are provided in facing contact with the left and right surfaces of the interior section respectively. The outer legs have short incurved ends 70. The incurved ends of the outer legs contact the left and right surfaces of the interior section respectively.

A coupling assembly includes upper and lower unthreaded apertures 74, 76. The unthreaded apertures extend through the outer leg of the left component. The coupling assembly includes upper and lower threaded apertures 78, 80. The threaded apertures extend through the outer leg of the right component. The upper threaded and unthreaded apertures are aligned with the upper aperture of the interior section of the bracket assembly. An upper bolt 82 is provided. The upper bolt extends through all of the upper apertures. The upper bolt is threadedly received in the upper threaded aperture. In this manner the coupling between the bracket assembly and the frame member is tightened. The lower threaded and unthreaded apertures are aligned with the lower aperture of the interior section. A lower bolt 84 is provided. The lower bolt extends through all of the lower apertures. The lower bolt is threadedly received in the lower threaded aperture. In this manner the coupling between the bracket assembly and the frame member is loosened and tightened.

In an alternate embodiment 100 of the present invention the vertical frame member has a central plane. The side component have inner legs 104. The central plane is equally spaced from the inner legs of the side components. The inner legs have surfaces 106. The surfaces of the inner legs are provided parallel with respect to the central plane. Note FIG. 4.

In the next alternate embodiment 200 of the present invention the bracket assembly includes two similarly configured bracket assemblies 204, 206. The bracket assemblies are laterally spaced from each other. The two bracket assemblies are supported by two parallel frame members 208, 210. Each central component has an exterior section 212, 214. The exterior section of each central component extends laterally from an associated interior section. Each exterior section has an outboard hole 216, 218. Each exterior section has an inboard hole 220, 222. The inboard holes are provided at an elevation above than the outboard holes. An outboard rod 224 is provided. The outboard rod extends between the outboard holes. The outboard road functions as a towel rack. An inboard rod 224 is provided. The inboard rod extends between the outboard holes. In this manner use as a towel rack is facilitated. Note FIG. 5-7.

In another alternate embodiment 300 of the present invention an outboard section 304 is provided. The outboard section has an upper edge 306. The upper edge of the outboard section is provided in a horizontal plane over the majority of its extent. A notch 308 is provided. The notch is provided at a location remote from the interior section. In this manner use as a support for a planter is facilitated. Note FIG. 8.

Figure 9:
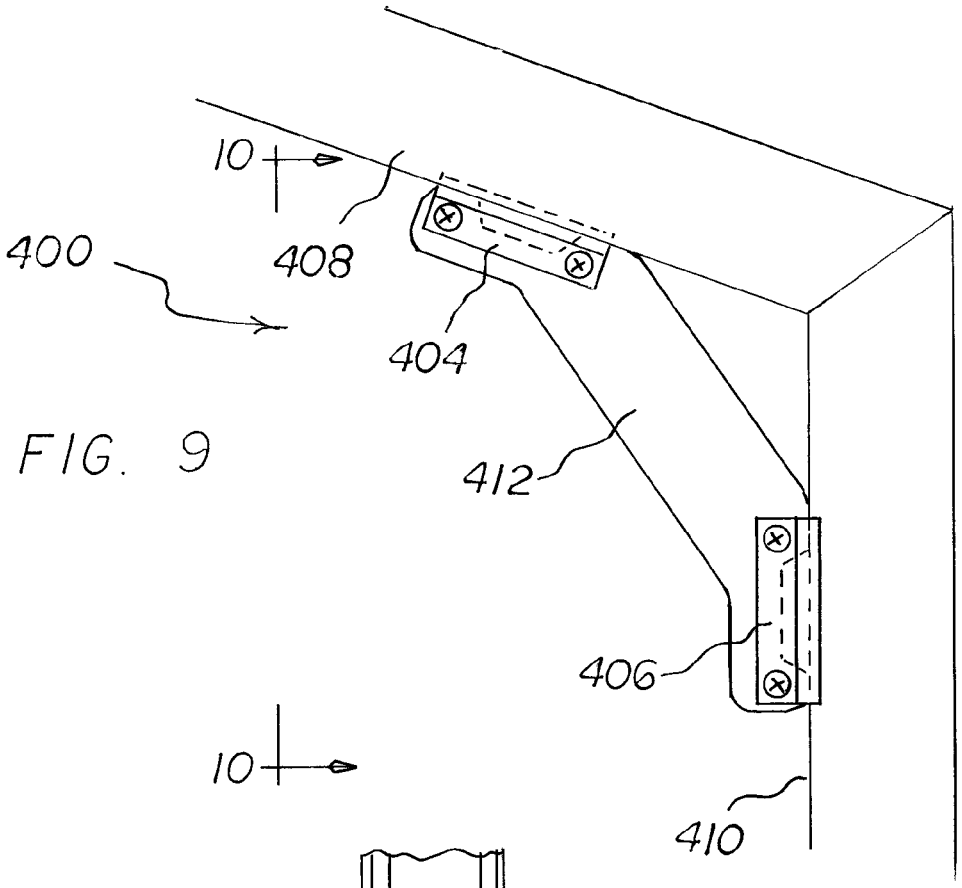
FIG. 9 is a plan view of a final alternate embodiment of the invention.
Figure 10:
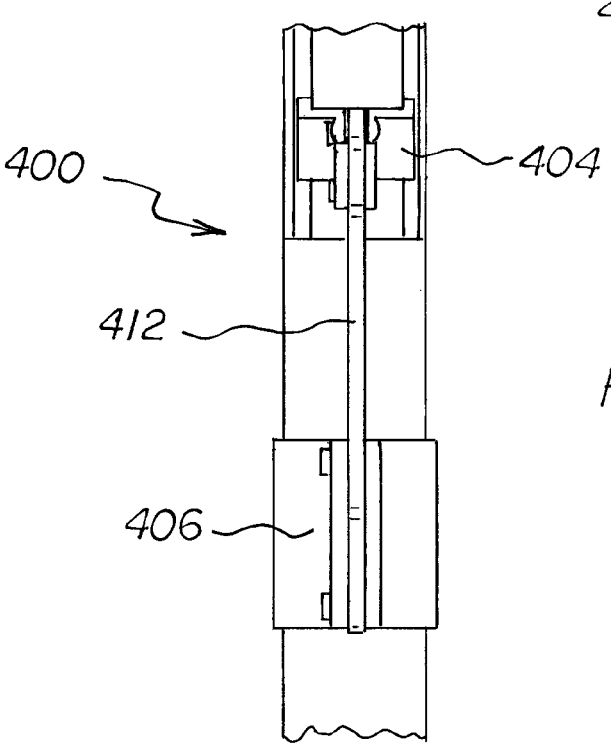
FIG. 10 is a side elevational view taken along line 10-10 of FIG. 9.

In the last alternate embodiment 400 of the present invention the bracket assembly includes two similarly configured bracket assemblies 404, 406. The two bracket assemblies are elevationally spaced from each other. Two frame members 408, 410 are provided. The two bracket assemblies are supported by the two frame members. A common exterior section 412 is provided. The exterior section extends between the two interior sections. In this manner use as a gusset is facilitated. Note FIGS. 9 and 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A screen enclosure clamp system (10) for removably receiving and supporting swimming-related, swimming pool-related, decorative and screen structural support-related objects at convenient locations within screened enclosures, the receiving and supporting being done in a safe, eye-appealing, convenient and economical manner, the system comprising, in combination:

a vertically extending frame member (16) constituting a portion of a screen enclosure, the frame member formed with a vertically extending front face (18) and laterally spaced vertical left and right recesses (20), (22) on opposite sides of the front face, the recesses being configured to include opposed left and right side faces (24), (26), each side face forming a first acute angle greater than 85 degrees with respect to the front face, the frame member forming a vertical central plane perpendicular to the front face and equally spaced from the side faces;

a bracket assembly (30) removably coupled to the frame member, the bracket assembly including a central component (32) formed with an interior section (34) and an exterior section (36), the interior section having an inside edge (38) positioned in contact with the front face of the frame member, the interior section having upper and lower apertures (40), (42) with vertically aligned axes, the inside edge configured with a recessed edge (44) between the apertures and aligned with the axes, the exterior section having a U-shaped leg (46) integrally formed as an extension of the interior section laterally spaced from the lower aperture, the U-shaped leg having a midpoint at an elevation beneath the lower aperture, the interior and exterior sections being vertically oriented and containing the central plane, the interior section having a planar left surface (48) and a planar right surface (50);

the bracket assembly also including a left component (54) and a similarly configured right component (56), the left component having a middle leg (58) facing the front face of the frame member between the left surface of the interior section and the left side face of the recess, the right component having a middle leg (60) facing the front face of the frame member between the right surface of the interior section and the right side face of the recess, the left and right components having inner legs (62), (64) in facing contact with the left and right side faces of the recess respectively, the inner legs forming a second acute angle with respect to the middle leg equal to the first acute angle, the left and right components having outer legs (66), (68) in facing contact with the left and right surfaces of the interior section respectively, the outer legs having short incurved ends (70) contacting the left and right surfaces of the interior section respectively; and a coupling assembly including upper and lower unthreaded apertures (74), (76) extending through the outer leg of the left component and upper and lower threaded apertures (78), (80) extending through the outer leg of the right component, the upper threaded and unthreaded apertures aligned with the upper aperture of the interior section of the bracket assembly, an upper bolt (82) extending through all of the upper apertures and threadedly received in the upper threaded aperture for tightening the coupling between the bracket assembly and the frame member, the lower threaded and unthreaded apertures aligned with the lower aperture of the interior section, a lower bolt (84) extending through all of the lower apertures and threadedly received in the lower threaded aperture for tightening and loosening the coupling between the bracket assembly and the frame member.

* * * * *